US008448961B2

(12) United States Patent
Francom et al.

(10) Patent No.: US 8,448,961 B2
(45) Date of Patent: May 28, 2013

(54) APPARATUS, SYSTEM, AND METHOD FOR OPEN FRAMES FOR SPORT DECKS

(75) Inventors: Larry Francom, Malad City, ID (US); Justin Francom, Malad City, ID (US)

(73) Assignee: Larry Francom, Malad, ID (US)

( * ) Notice: Subject to any disclaimer, the term of this patent is extended or adjusted under 35 U.S.C. 154(b) by 495 days.

(21) Appl. No.: 12/546,558

(22) Filed: Aug. 24, 2009

(65) Prior Publication Data

US 2010/0075128 A1 Mar. 25, 2010

Related U.S. Application Data

(60) Provisional application No. 61/091,278, filed on Aug. 22, 2008.

(51) Int. Cl.
*B62M 1/00* (2010.01)

(52) U.S. Cl.
USPC ..... 280/87.041; 280/87.042

(58) Field of Classification Search
USPC ..... 280/87.01, 87.021, 87.03, 87.041, 280/87.042
See application file for complete search history.

(56) References Cited

U.S. PATENT DOCUMENTS

| | | | | |
|---|---|---|---|---|
| 1,327,123 | A | | 1/1920 | Thomas |
| 1,620,939 | A | | 11/1923 | Behm |
| 3,399,904 | A | | 9/1968 | Schinke |
| D222,158 | S | | 10/1971 | Noches |
| 3,827,706 | A | | 8/1974 | Milliman |
| 3,926,449 | A | | 12/1975 | Wilje |
| 4,106,786 | A | | 8/1978 | Talbot |
| 4,134,599 | A | | 1/1979 | DiMille et al. |
| 4,708,352 | A | | 11/1987 | Vullierme |
| 4,865,342 | A | | 9/1989 | Kong |
| 4,886,298 | A | | 12/1989 | Shols |
| 5,062,630 | A | | 11/1991 | Nelson |
| 5,080,382 | A | | 1/1992 | Franz |
| 5,104,251 | A | * | 4/1992 | Fillman et al. ..... 403/191 |
| 5,125,687 | A | | 6/1992 | Hwang |
| 5,160,155 | A | | 11/1992 | Barachet |
| 5,195,781 | A | | 3/1993 | Osawa |
| 5,233,737 | A | * | 8/1993 | Policelli ..... 285/390 |
| 5,540,455 | A | | 7/1996 | Chambers |
| 5,549,331 | A | | 8/1996 | Yun et al. |
| 5,738,818 | A | * | 4/1998 | Atmur et al. ..... 264/624 |
| 5,810,376 | A | | 9/1998 | Matheny |
| 5,901,981 | A | | 5/1999 | Lucht |
| 5,915,707 | A | | 6/1999 | Steffen |
| 5,927,732 | A | | 7/1999 | Snyder |
| 5,975,546 | A | | 11/1999 | Strand |
| 5,984,328 | A | | 11/1999 | Tipton |
| 6,059,303 | A | | 5/2000 | Bradfield |

(Continued)

*Primary Examiner* — Hau Phan
*Assistant Examiner* — Bryan Evans
(74) *Attorney, Agent, or Firm* — Kunzler Law Group, PC

(57) ABSTRACT

A sport deck is formed with at least one pattern of tow fibers forming a platform for supporting a weight of a user when riding on a sport deck. The pattern of tow fibers form at least one through opening and at least one intersection of the tow fibers in which at least some of the tow fibers overlie others of the tow fibers. The intersections may be formed with tow fibers of a plurality of materials overlying each other to form layers having a plurality of respective characteristics. The platform may comprise a plurality of patterns of tow fibers. The intersection may be selectively located to strengthen the deck. The tow fibers may form a frame with a skin at least partially covering the frame of tow fibers.

15 Claims, 9 Drawing Sheets

U.S. PATENT DOCUMENTS

| | | | | |
|---|---|---|---|---|
| 6,059,307 | A | 5/2000 | Western | |
| 6,182,986 | B1 | 2/2001 | Smith | |
| 6,386,561 | B1 | 5/2002 | Hanson | |
| 6,428,022 | B1 | 8/2002 | Namiki | |
| 6,527,284 | B2 | 3/2003 | Bert | |
| 6,592,129 | B1 | 7/2003 | Gates | |
| D478,643 | S | 8/2003 | Langford et al. | |
| 6,854,748 | B2 | 2/2005 | Wimbish et al. | |
| 6,910,698 | B2 | 6/2005 | Turner et al. | |
| 6,979,006 | B2 | 12/2005 | Pierron | |
| 7,000,930 | B2 | 2/2006 | Smith | |
| 7,083,178 | B2 | 8/2006 | Potter | |
| 7,195,259 | B2 | 3/2007 | Gang | |
| 2002/0070514 | A1 | 6/2002 | Costa, Jr. et al. | |
| 2002/0149166 | A1 | 10/2002 | Potter | |
| 2002/0167141 | A1* | 11/2002 | Humphrey | 280/87.041 |
| 2004/0183269 | A1 | 9/2004 | Hadzicki et al. | |
| 2004/0188967 | A1 | 9/2004 | Gallo | |
| 2004/0222609 | A1 | 11/2004 | Schmitt | |
| 2004/0227318 | A1* | 11/2004 | Beleski, Jr. | 280/87.041 |
| 2005/0134013 | A1* | 6/2005 | Wright et al. | 280/87.042 |
| 2006/0012141 | A1 | 1/2006 | Bouvet | |
| 2006/0279055 | A1 | 12/2006 | Morabito | |
| 2007/0001414 | A1 | 1/2007 | Kang | |
| 2007/0085290 | A1 | 4/2007 | Findling | |

* cited by examiner

APPARATUS, SYSTEM, AND METHOD FOR OPEN FRAMES FOR SPORT DECKS

CROSS-REFERENCES TO RELATED APPLICATIONS

This application claims priority to U.S. Provisional Patent Application No. 61/091,278 entitled "APPARATUS, SYSTEM, AND METHOD FOR OPEN FRAMES FOR SPORT DECKS", filed on Aug. 22, 2008 for Larry Francom and Justin Francom, which is incorporated herein by reference.

BACKGROUND

Many popular pursuits today involve decks upon which a rider stands, lays, or sits. One popular sport is skate boarding. The decks of skate boards are preferred to be lightweight, but must be sturdy due to the nature of the sport. Skate board decks have been made out of wood, plastic, and recently carbon fiber. Skate boards have evolved and improved, but skateboarders are constantly desiring lighter, stronger decks. Other sports similarly provide a great demand for a lighter, stronger deck.

SUMMARY

The present invention has been developed in response to the present state of the art, and in particular, in response to the problems and needs in the art that have not yet been fully solved by currently available sport deck manufacturing techniques. Accordingly, the present invention has been developed to provide an apparatus, system, and method for forming open frames for sport decks that overcome many or all of the shortcomings in the art.

In a simple form, a sport deck in accordance with embodiments of the present invention includes at least one pattern of tow fibers forming a platform for supporting a weight of a user when riding on a sport deck. The pattern of the tow fibers forms at least one through opening between strands of the tow fibers.

In one embodiment, the pattern of tow fibers includes at least one intersection of the tow fibers in which at least some of the tow fibers overlie others of the tow fibers. In one embodiment, the intersection comprises tow fibers of a plurality of materials overlying each other to form layers having a plurality of respective characteristics. In another embodiment, the platform includes a plurality of patterns of tow fibers. In this embodiment at least a portion of one pattern overlies at least a portion of another pattern. In another embodiment at least one intersection is located at a position of the deck to form a strengthened region of the deck at the position and surrounding portions thereof. Alternatively or additionally, tow fibers of predetermined materials are selectively positioned to provide strengthening or other characteristics to those regions of the deck in which they are positioned. Predetermined materials or a plurality of intersections may be located at positions of the deck for imparting strength or other characteristics to the deck in those positions. In another embodiment, the tow fibers form a frame, and a skin or housing at least partially covers the frame of the tow fibers.

In another simple form, embodiments of the invention include a method of forming a sport deck. The method includes forming tow fibers into at least one pattern and hardening the fibers in the pattern. In this method, forming and hardening include forming at least one through opening between portions of the tow fibers.

In one embodiment, forming the tow fibers includes placing the tow fibers in a mold having the pattern. In another embodiment, forming the tow fibers includes intersecting the tow fibers such that at least one of set of the tow fibers crosses over itself or crosses over another set of tow fibers of another pattern forming the sport deck.

In other embodiments, the method includes forming the tow fibers including placing predetermined materials in predetermined regions of a sport deck. In one embodiment, forming the tow fibers includes forming intersections at predetermined locations in the deck to create strengthened regions in the deck. In another embodiment, forming the tow fibers includes extending a set of tow fibers a predetermined length without intersection with another set of tow fibers in order to create a flexible region in the sport deck. In another embodiment, the method includes creating a frame for the sports deck by the operations of forming and hardening, and placing a skin over at least a portion of the frame.

A system of the present invention may include the apparatus including any of the details of the sport deck in combination with other features of the sport deck. For example the system may include one or more wheels and/or wheel mounting bases when the sport deck is a wheel board. When the sport deck is a snowboard or ski, the system may include additional details with regard to the skin or attachments to the skin and/or frame. For example, bindings and/or contours on the surfaces of the sport decks may form part of systems in accordance with embodiments of the present invention.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. The invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

The accompanying drawings depict only typical embodiments of the invention and are not therefore to be considered to be limiting of its scope. Embodiments of the invention are described and explained with some specificity with regard to the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples user selections, etc., to provide a thorough understanding of embodiments of the invention. However, the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
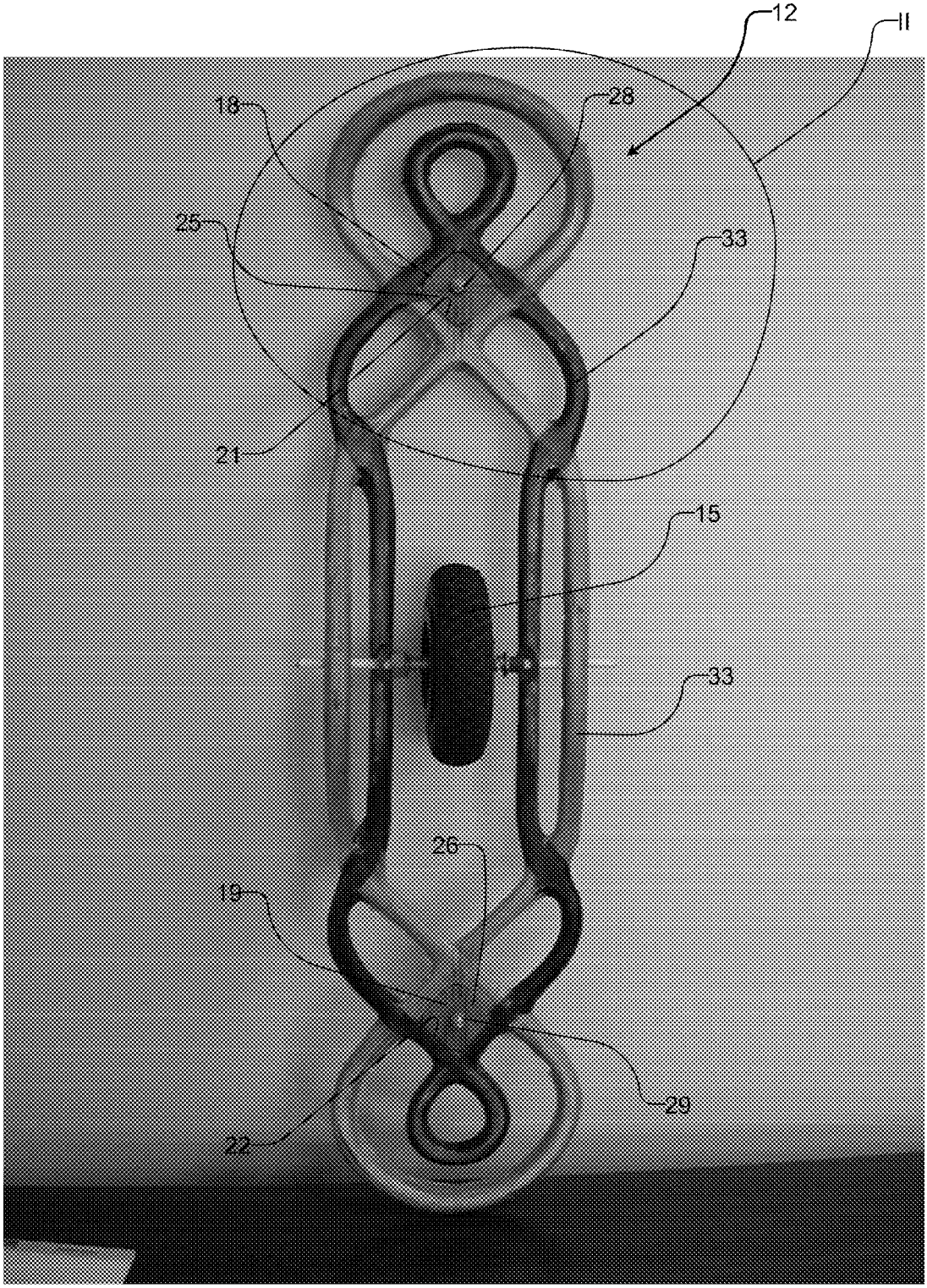
FIG. 1 is a top plan view of one embodiment of a frame for a sport deck in accordance with the present invention.

FIG. 1 is a top plan view of a frame 12 for a sport deck in accordance with embodiments of the present invention. In this embodiment, the frame 12 is a frame for a wheel board or wheel platform sport deck. As such, the frame 12 is configured to support a central wheel 15 and front and rear wheels via wheel mounting bases 18, 19. The wheel mounting bases 18, 19 fit within respective through openings 21, 22 in the frame 12 and may have top plates 25, 26 that are larger than dimensions of the through openings. A bolt 28, 29 or other fastener may be used to secure the top plates 25, 26 to the rest of the wheel mounting bases 18, 19 in order to mount the wheels at respective locations on the frame 12. While the frame 12 is illustrated as a wheel board frame. It is to be understood that a similar frame may form structural architecture for other sport decks including, but not limited to, snowboards, snow skis, water skis, surfboards, sleds, etc. For wheel boards, the frame may be used with or without any skin covering the frame 12. On the other hand, for wheel boards and other types of sports decks skins may be applied to any portion or the whole frame.

Figure 2:
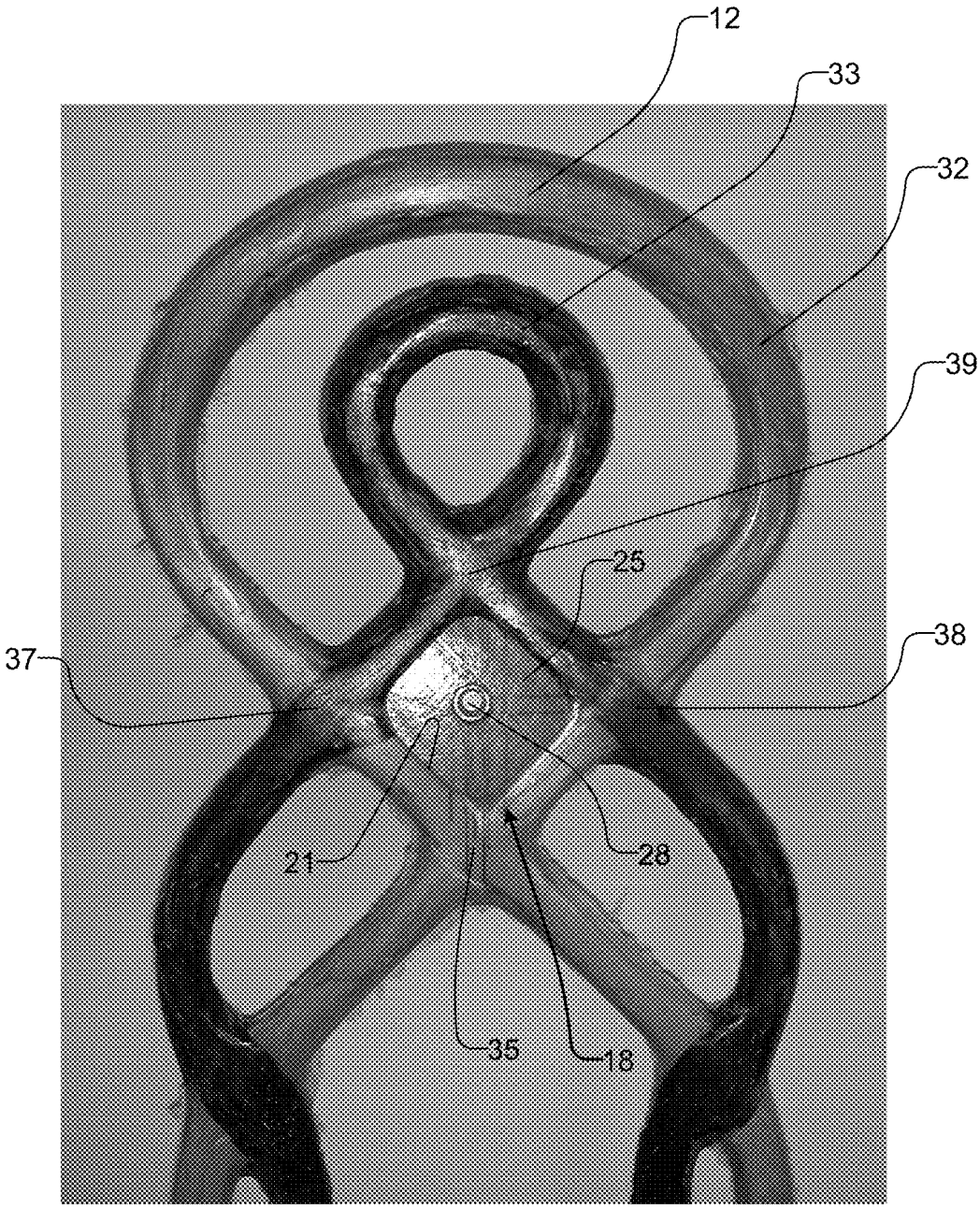
FIG. 2 is a detailed view of an encircled portion II of the frame for the sport deck of FIG. 1.

FIG. 2 is a detailed view of the encircled portion II of the frame 12 shown in FIG. 1. FIG. 2 thus more clearly shows the wheel-mounting base 18 with its top plate 25 held in place by bolt 28. FIGS. 1 and 2 show the frame having two overlying patterns 32, 33 distinguishable by their light and dark colorations. As may be appreciated, the through opening 21 is formed by a hardened composite material including tow fibers in the first pattern 32 on first and second sides and by hardened composite material including tow fibers in the second pattern 33 on third and fourth sides. By intersections with itself at 35 and by intersections with the composite material of the second pattern 33 at 37, 38, the first pattern 32 helps to form a closed loop through opening Likewise, the second pattern 33 includes the tow fibers of the composite material of the second pattern crossing itself at 39 and the composite material of the first pattern 32 at 37, 38 as shown in FIG. 2. The patterns 32, 33 cross each other at multiple other locations forming strengthening intersections, as also shown in FIGS. 1 and 2.

As shown, each pattern may include one or more materials specific to that pattern and the locations in the frame 12 that are reached by the pattern. For example, in the illustrated embodiment of FIGS. 1-2, the pattern 32 may be formed of material(s) having greater flexibility and/or wear resistant qualities while the pattern 33 may be formed of a material having greater strength. In this example, the materials of the first pattern may include Kevlar™ for wear resistance and damping and fiberglass for flexibility. On the other hand, the material of the second pattern may be carbon fiber to impart greater strength in the regions this pattern reaches. Alternatively or additionally, locations or regions within each pattern may include particular materials having predetermined characteristics that are to be imparted to these locations or regions. For example, tow fibers of Kevlar™ may be placed along outer front, rear and/or side edges of the frame to impart greater wear resistance in these locations that are prone to more contact with concrete and other abrasive surfaces during riding.

Figure 3:
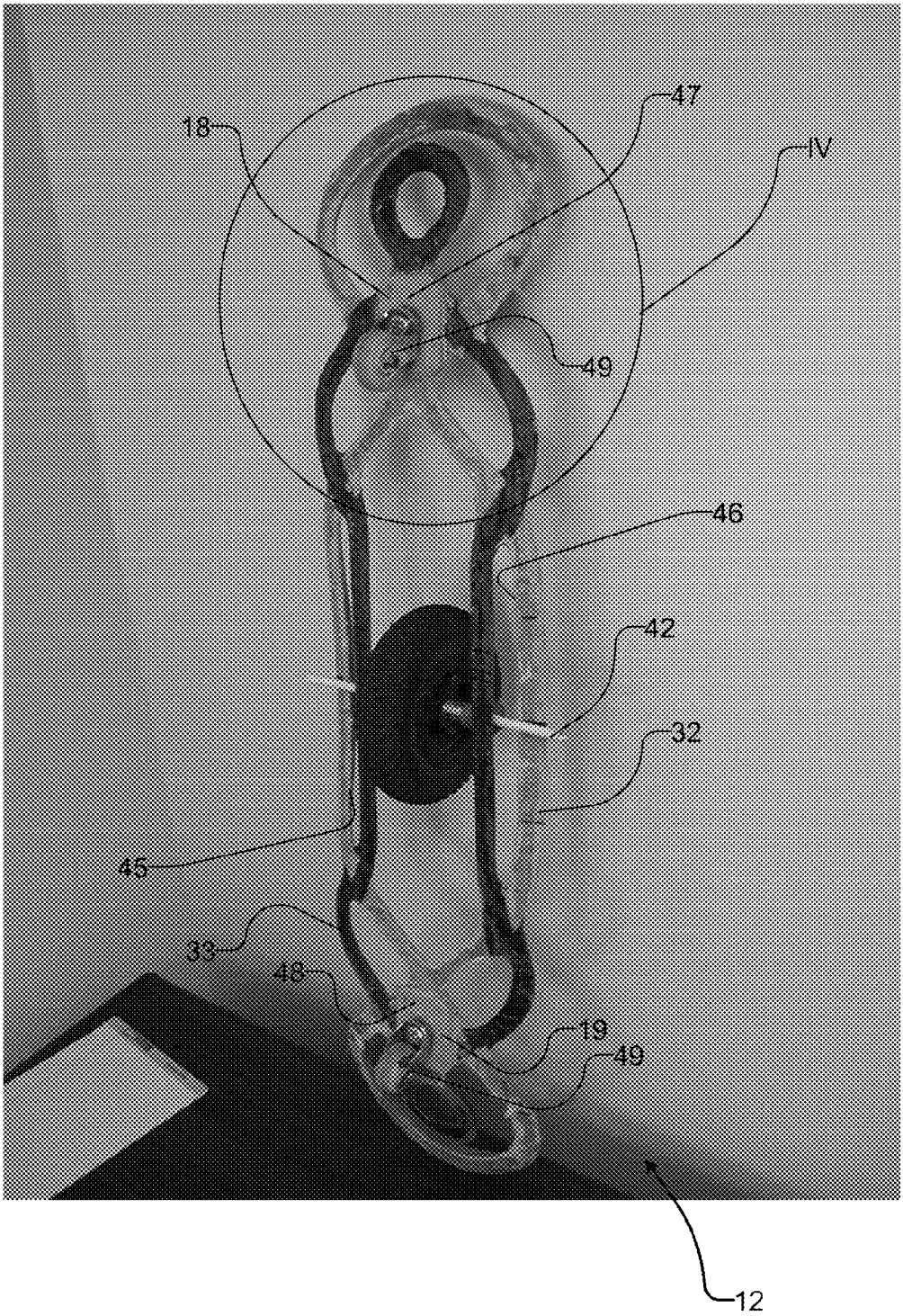
FIG. 3 is a bottom perspective view of the frame of FIGS. 1 and 2.

FIG. 3 is a bottom perspective view of the frame 12 of the sport deck of FIGS. 1 and 2. In this view it can be seen that additional mounting structure could be incorporated to secure an axle 42 to the composite materials of the first and second patterns 32, 33. Alternatively or additionally elongate through openings 45, 46 could be utilized to secure smaller lateral wheels in a diamond configuration similar to the description of embodiments shown and described with regard to co-pending U.S. patent application Ser. No. 12/197,216, entitled "APPARATUS, SYSTEM, AND METHOD FOR WHEELED APPARATUS", the disclosure of which is incorporated herein by reference.

Figure 4:
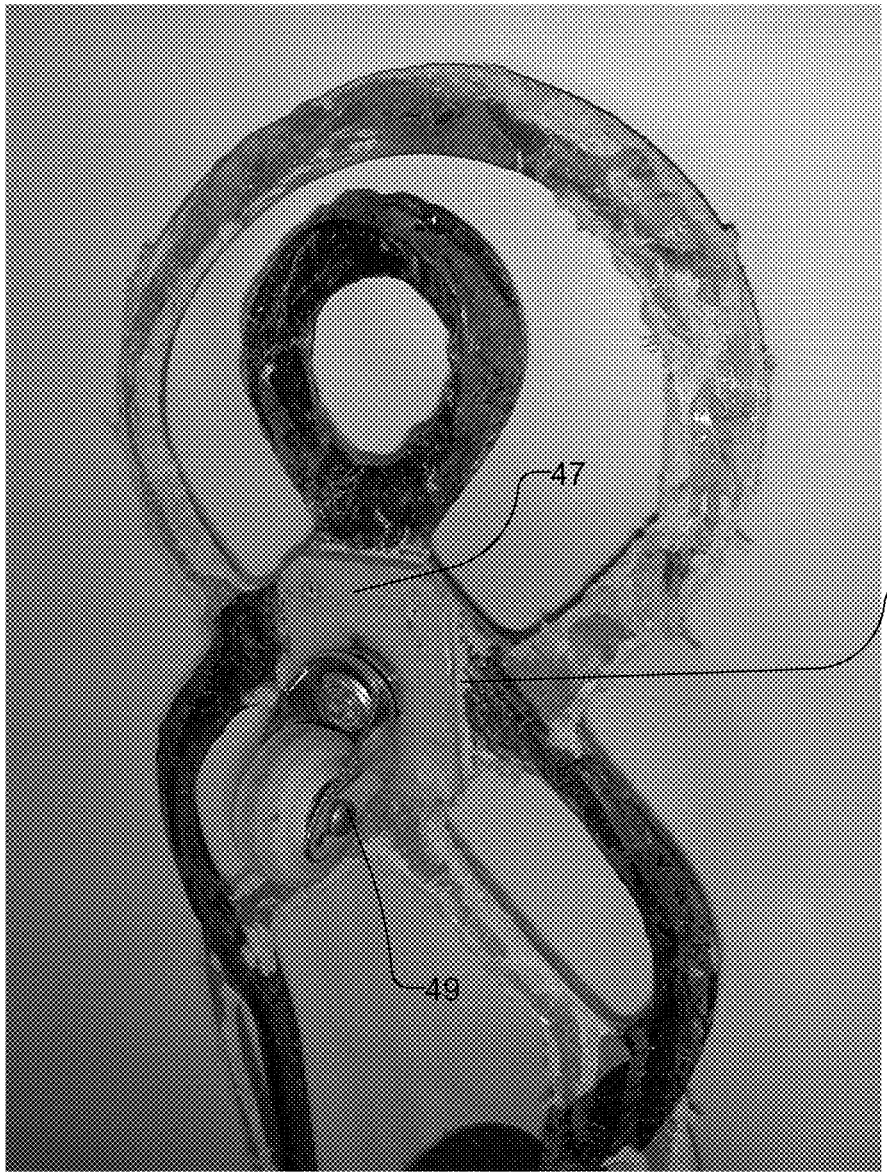
FIG. 4 is detailed view of an encircled portion IV of the frame shown in FIG. 3.

FIG. 4 is detailed view of an encircled portion IV of the frame shown in FIG. 3. This view more clearly shows a front one of bottom plates 47, 48 of the wheel mounting bases 18, 19. Each of the bottom plates 47, 48 supports a caster 49 thereon for engagement with the ground during use. The wheel mounting bases 18, 19 or other wheel mounting bases may be used to mount other wheels, or may be used to mount wheels at other positions on the frame 12.

Figure 5:
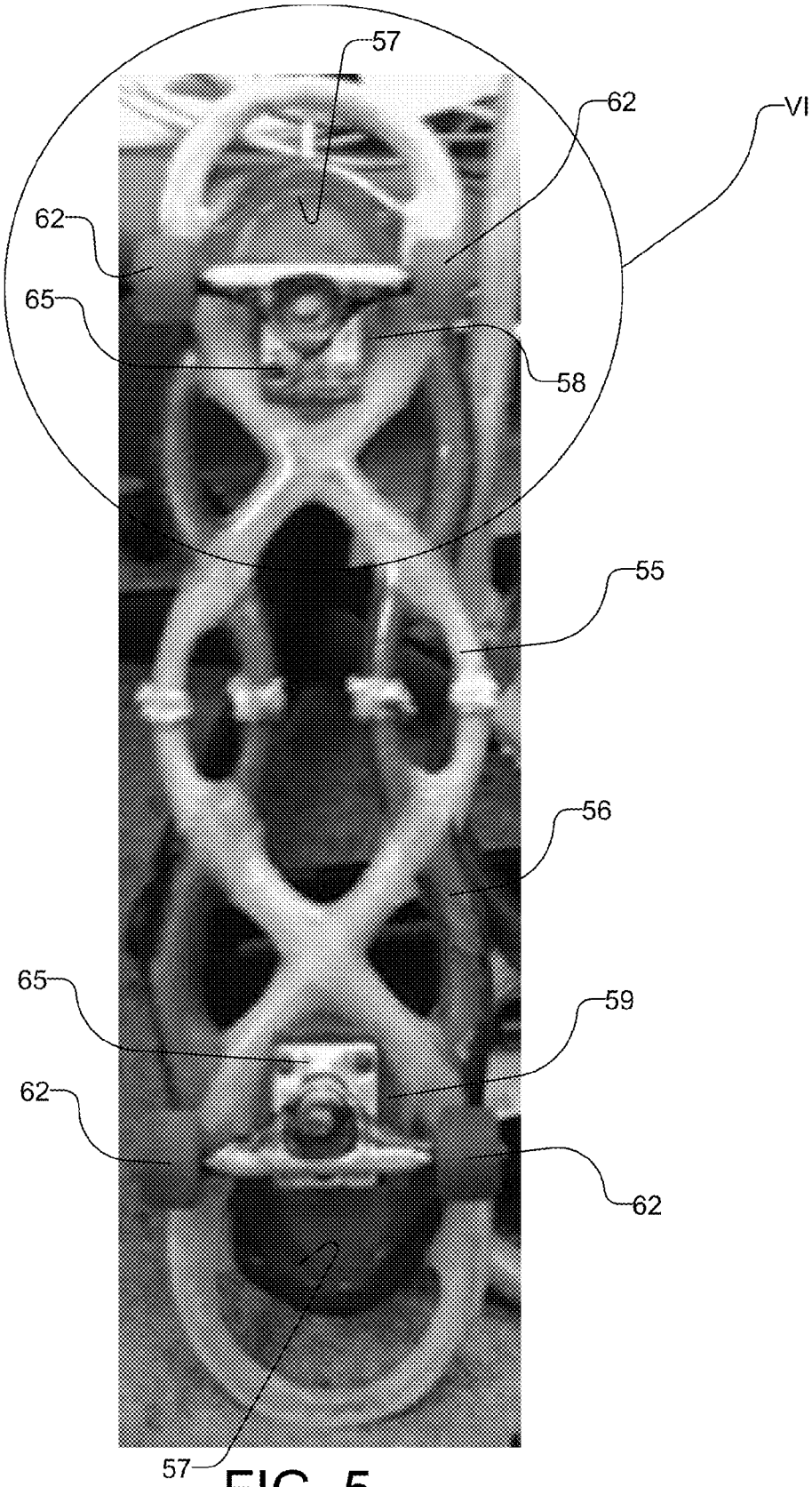
FIG. 5 is a bottom plan view of another embodiment of a frame for a sport deck.

FIG. 5 is a bottom plan view of another embodiment of a frame 52 for a sport deck. In this case, the frame 52 also has tow fibers formed in a first pattern 55 and a second pattern 56 that overlap or overlie each other Like the embodiment of FIGS. 1-4, the patterns may include tow fibers of different materials in predetermined locations or regions. Intersections form closed loop through openings including through openings 57 in which wheel mounting bases 58, 59 are disposed. However, in this embodiment, wheels 62 are supported on skate board style wheel trucks 65, which are attached to the wheel mounting bases 58, 59.

Figure 6:
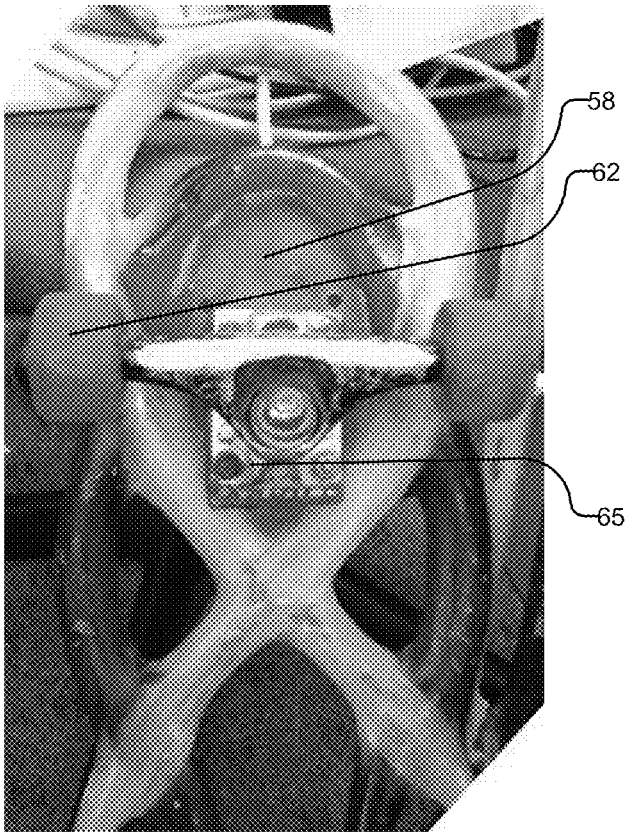
FIG. 6 is a detailed view of an encircled portion VI of the frame for a sport deck of FIG. 5.

FIG. 6 is a detailed view of an encircled portion VI of the frame 52 of FIG. 5. In this view, the wheel mounting base 58 is shown in greater detail as including a hardened composite material that has been molded into the through opening.

Figure 7:
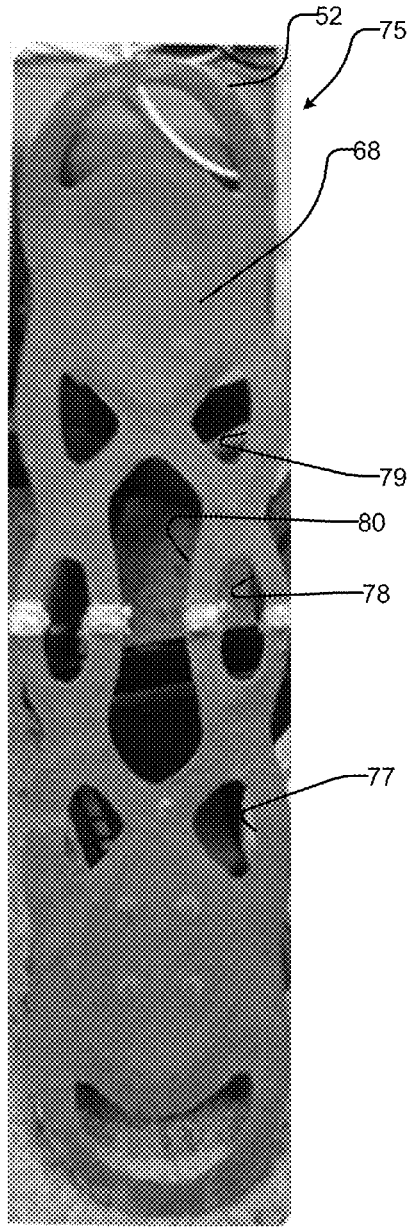
FIG. 7 is a top plan view of the frame of FIGS. 5 and 6 with a skin on at least a portion of the frame.

FIG. 7 is a top plan view of the frame 52 of FIGS. 5 and 6 with a skin 68 on at least a portion of the frame. As with any of the through openings shown and described herein, end through openings 71, 72 may form handles that can be easily grasped by a user to aid in performing tricks or for carrying a wheel board 75 formed of the frame 52. Other through openings 77, 78, 79, 80 may be used to provide handles or support wheels, as described herein. The skin 68 may take any of a variety of forms including a fiberglass or plastic sheet of material covering part or all of the frame 52. Alternatively, the skin may be provided as a housing of plastic or other material that fittingly receives and at least partially encloses the frame 52. For snowboard type sport decks, for example, the skin may provide channels or other structure in a top surface while a bottom surface is generally flat and smooth.

Figure 8:
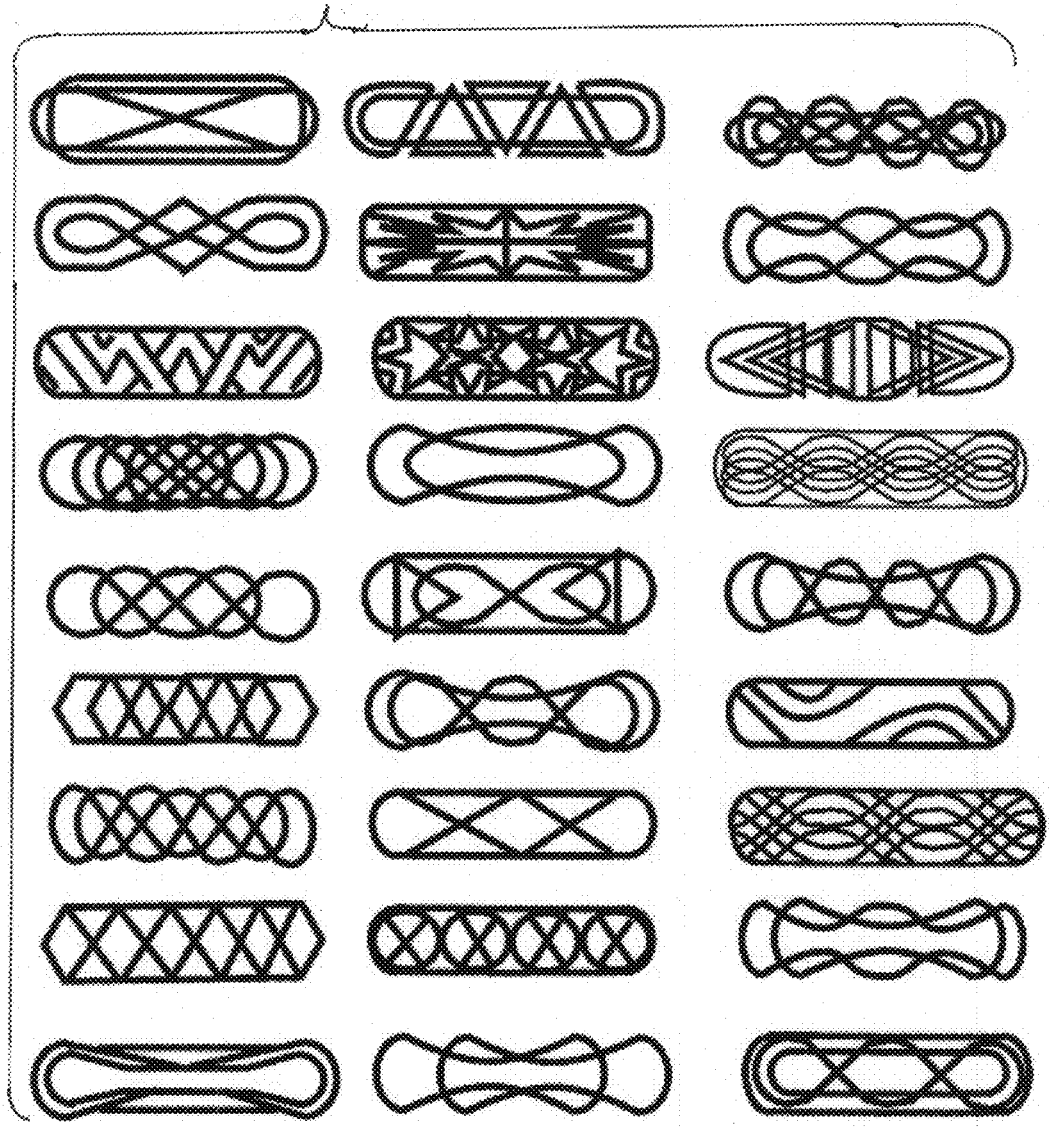
FIG. 8 is a diagrammatic view of a variety of example pattern configurations for frames and molds for sport decks.

FIG. 8 is a diagrammatic view of a variety of example pattern configurations 83 for frames and molds for sport decks. As may be appreciated, the patterns include many configurations that have intersections in which tow patterns can be made to intersect each other. It is to be understood that the patterns are not to be limited to those shown in FIG. 8. Rather the patterns may be of any configuration already known or not yet discovered.

Figure 9:
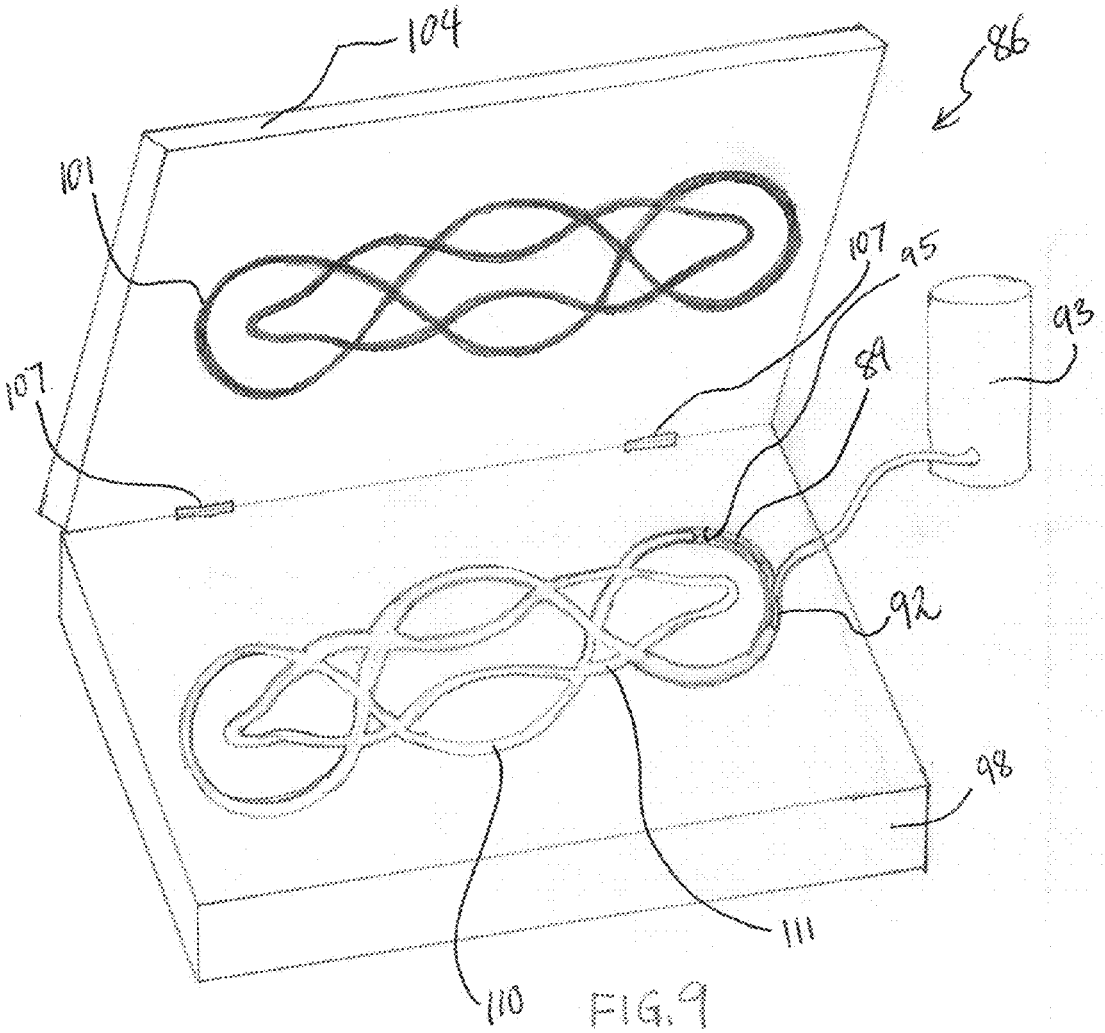
FIG. 9 is a diagrammatic perspective view of a mold for receiving tow fibers and resin in accordance with embodiments of a method of forming frames for sport decks.

FIG. 9 is a diagrammatic perspective view of a mold 86 for receiving tow fibers 89 and resin 92 such as from a canister 93 in accordance with embodiments of a method of forming frames for sport decks. The mold includes a recessed portion 95 in a base 98 of the mold 86 and a complementary protruding portion 101 on the cover or cowl 104. The protruding portion 101 and the recessed portion each have the same pattern and are of substantially the same size so that the protruding portion 101 is received into the recessed portion 95 in a relatively tight fitting relation. Once the tow fibers 89 and resin 92 have been placed in the recessed portion 95, then the cowl is brought down over the base 98 such as by the action of hinges 107. It is to be understood that any of a variety of clamping or securing mechanism with or without hinges may be used to secure the cowl 104 with its protruding portion 101 in place on the base. For example, a plurality of threaded rods may be positioned at distributed points on the cowl 104 to adjustably apply pressure to predetermined points on the protruding portion 101 and apply an evenly distributed force to the material in the recessed portion 95. The protruding portion 101 engages the tow fibers 89 in the recessed portion 95 and forces excess resin 92 out of interstices between fibers 89 of the tow material to increase a ratio of the fibers 89 to resin 92. The protruding portion 101 also forces any excess resin 92 from the recessed portion 95. The resulting frame may have a fiber to resin ratio in a range from approximately 50/50 to 90/10 percent. The ratio of fiber to resin may be in a range from 60/40 to 85/15. The ratio of fiber to resin may be in a range from 70/30 to 80/20. Other forms of molding the frames may include vacuum molding, compression molding, or resin transfer molding. The ratio of fiber to resin may be any value within or outside the ranges set forth above.

The tow fibers may be placed in the recessed portion by layering the fibers 89 as continuous fibers cut to a desired length such as a length to make a complete circuit around one of patterns 110, 111. For example, fibers 89 may be placed in a portion of the recessed portion corresponding to the first pattern 110 to form a first layer. Then fibers 89 may be placed in a portion of the recessed portion corresponding to the second pattern 111 to form a second layer. Additional layers may be placed in the first and second patterns 110, 111 to form alternating layers, without limitation, to fill up the recessed portion 95. A variety of materials may be used in respective layers. Alternatively or additionally, different materials may be used in different regions of each pattern and/or different regions within each layer within the patterns. In one embodiment, the tow fibers are chopped tow fibers, and are placed in the resin to form a slurry that is then placed in the recessed portion 95. The chopped tow fibers may have lengths in a range from one-sixteenth to one-eighth inch, for example. In this embodiment, the chopped tow fibers may be enlarged at their ends or may swell at their ends when exposed to the resin such that they generally resemble dog bones. These dog bone configured chopped tow fibers then form keyed structural relationships with surrounding resin and/or each other. The result is a very strong composite material in the hardened state. In another embodiment, the fibers are pre-impregnated with a resin such that a predetermined ration of fiber to resin is preliminarily established. In any case, the method includes hardening through any of a variety of catalysis operations, which may include applying one or more of heat, chemicals, and or combining two epoxy materials. Further alternatively, the frame may be formed by filling the mold with a non-fiber reinforced resin. That is, a resin alone may be placed in the recessed portion 95 and catalyzed to form the hardened frame. Materials for forming the open frame sports deck may include, but are not limited to, Materials include fiberglass, carbon (such as S-glass), graphite, Kevlar™, Barotex™, and any other fiber composite materials derived from organic and/or inorganic substances. These fiber composite materials may include without limitation a lava pumice derived material, salt(s), ceramic(s), acrylic(s), wood/paper, plants and/or vines etc.

Figure 10:
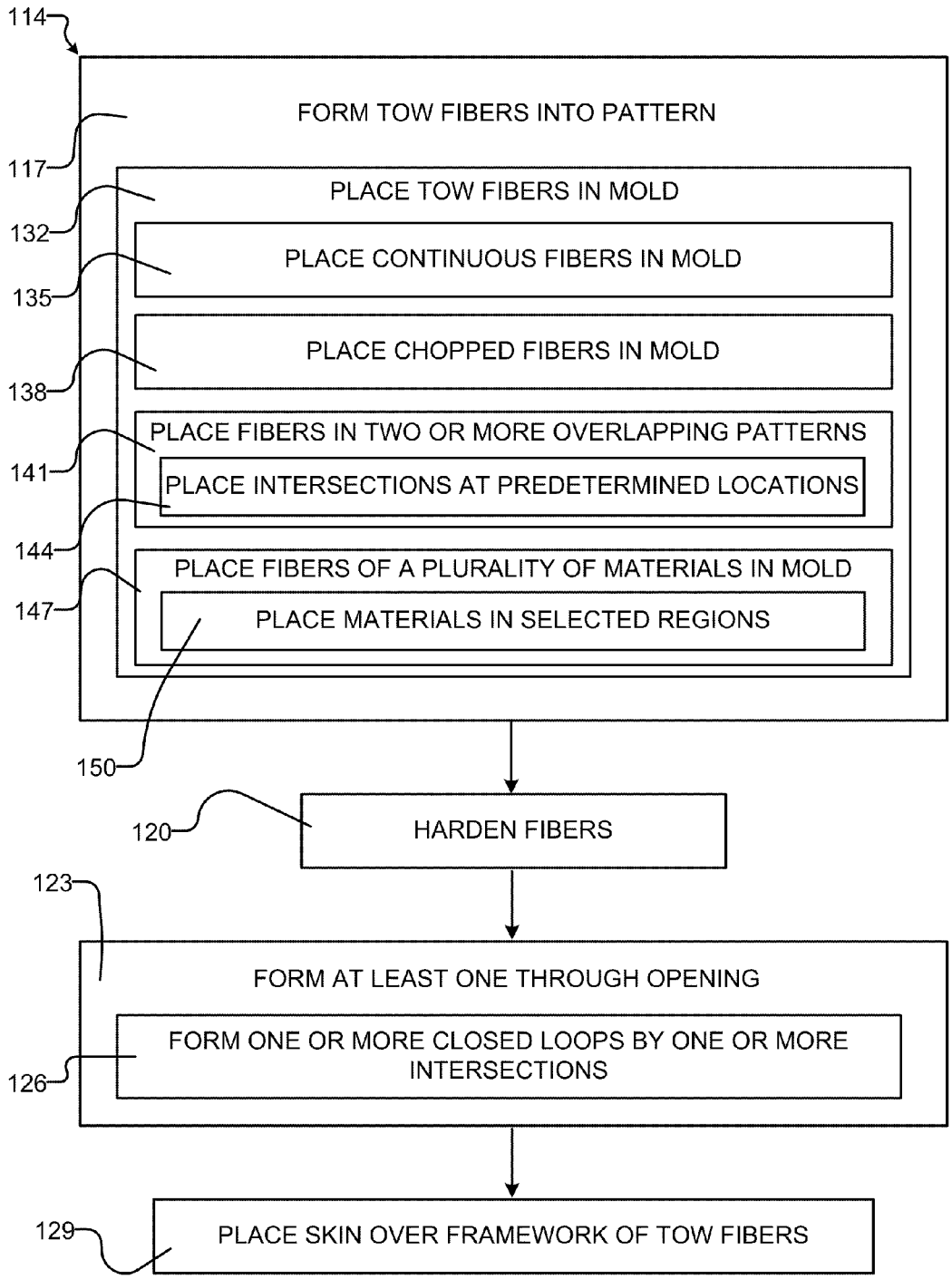
FIG. 10 is a block diagram of embodiments of a method of making a sport deck.

FIG. 10 is a block diagram of embodiments of a method 114 of making a sport deck. As such, the method may include forming frames for sport decks, as shown and described herein. The method may include forming tow fibers into at least one pattern as indicated at 117. Then the tow fibers are hardened such as by a catalysis operation, as indicated at 120. The operations of forming tow fibers into at least one pattern and hardening the fibers may result in forming at least one through opening in the resultant frame for sport decks, as indicated at 123. The operation of forming at least one through opening may include creating one or more closed loops by forming one or more intersections between the sets of tow fibers as indicated at 126. Another step may include placing a skin over the frame formed by the tow fibers, as indicated at 129.

Forming tow fibers into at least one pattern 117 may include any of a variety of additional operations. For example, forming the tow fibers into at least one pattern may include placing continuous or chopped tow fibers into a mold, as indicated at 132, 135, and 138. The method 114 may also include placing the fibers in two or more overlapping patterns, as indicated at 141. This operation may include placing intersections at predetermined location, as indicated at 144. Alternatively or additionally, the method 114 may include placing fibers of a plurality of materials in the mold, as indicated at 147. This operation may include placing predetermined materials in predetermined and selected locations or regions in the patterns or layers of the tow material within the patterns, as indicated at 150.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sport deck comprising:

a closed-loop pattern formed from a plurality of continuous tow fibers, the closed-loop pattern forming a platform for supporting a weight of a user when riding on a sport deck;

a plurality of intersections, formed by the plurality of continuous tow fibers turning to intersect itself;

a plurality of segments of the plurality of continuous tow fibers formed between adjacent intersections; and wherein the plurality of segments form at least one hardened, closed-loop through opening.

2. The sport deck of claim 1, wherein at least one of the plurality of segments has a length one of less than or greater than a length of an adjacent one of the plurality of segments.

3. The sport deck of claim 1, wherein each of the plurality of intersections comprises a plurality of overlyings of the plurality of continuous tow fibers.

4. The sport deck of claim 1, wherein:

the platform comprises a plurality of closed-loop patterns; and at least a portion of a first pattern overlies at least a portion of a second pattern.

5. The sport deck of claim 1, wherein each of the plurality of intersections is located at a position of the sport deck, each of the plurality of intersections strengthening the deck at the position.

6. The sport deck of claim 1, wherein the plurality of continuous tow fibers form a frame, the sport deck further comprising a skin at least partially covering the frame.

7. The sport deck of claim 1, further comprising a wheel mounting base disposed within the at least one through opening.

8. The sport deck of claim 7, wherein the wheel mounting base is molded into the at least one through opening.

9. The sport deck of claim 1, wherein the at least one through opening forms a handle for carrying the sport deck.

10. The sport deck of claim 4, wherein the first pattern and the second pattern are enveloped by resin hardened in a single mold.

11. A platform comprising:

a closed-loop pattern formed from a continuous weave of a plurality of tow fibers, the closed-loop pattern forming a platform for supporting a weight of a user when riding on a sport deck;

a plurality of intersections, formed by the plurality of continuous tow fibers turning to intersect itself;

a plurality of segments of the plurality of continuous tow fibers formed between adjacent intersections; and wherein the plurality of segments form at least one hardened, closed-loop through opening.

12. The platform of claim 11, wherein at least one of the plurality of segments has a length one of less than or greater than a length of an adjacent one of the plurality of segments.

13. The platform of claim 12, wherein each of the plurality of intersections comprises a plurality of overlyings of the plurality of continuous tow fibers.

14. The platform of claim 12, wherein:

the platform comprises a plurality of closed-loop patterns; and at least a portion of a first pattern overlies at least a portion of a second pattern.

15. The platform of claim 14, wherein the first pattern and the second pattern are enveloped by resin hardened in a single mold.

* * * * *